US006295027B1

(12) United States Patent
Wixforth et al.

(10) Patent No.: US 6,295,027 B1
(45) Date of Patent: Sep. 25, 2001

(54) METHOD OF CALIBRATING A GROUP ANTENNA

(75) Inventors: Thomas Wixforth, Hildesheim; Mark Wiegmann, Paderborn, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/634,768

(22) Filed: Aug. 9, 2000

(30) Foreign Application Priority Data

Sep. 14, 1999 (DE) ..... 199 43 952

(51) Int. Cl.[7] ..... H01Q 3/22
(52) U.S. Cl. ..... 342/368; 342/174
(58) Field of Search ..... 342/173, 174, 342/368, 372

(56) References Cited

U.S. PATENT DOCUMENTS 5,086,302 * 2/1992 Miller ..... 342/373
5,940,032 8/1999 Passmann et al. .
6,157,343 * 12/2000 Anderson et al. ..... 342/371

FOREIGN PATENT DOCUMENTS 2 346 013 7/2000 (GB) .
95/34103 12/1995 (WO) .

* cited by examiner

*Primary Examiner*—Dao Phan
(74) *Attorney, Agent, or Firm*—Michael J. Striker

(57) ABSTRACT

A method of calibrating a group antenna with minimal effort includes sending a respective calibrating signal over corresponding transmitting branches (TX1, TX2, . . . , TXm) one after the other; detecting superimposed signal components coupled into respective individual antenna elements (A1, A2, . . . , Am) of the group antenna for each calibrating signal sent over the transmitting branches in the receiving branches (RX1, RX2, . . . , RXm) belonging to the respective individual antenna elements; deriving amplitude and phase variations of transmission functions of all transmitting branches (TX1, TX2, . . . , TXm) or receiving branches (RX1, RX2, . . . , RXm) relative to a transmission function of a reference transmitting or receiving branch from received signals including the superimposed signal components detected in the corresponding receiving branches (RX1, RX2, . . . , RXm) for all calibrating signals; and adjusting amplitude adjusting elements (ATX1, ATX2, . . . , ATXm) and phase adjusting elements (PTX1, PTX2, . . . , PTXm) in the respective individual transmitting branches (TX1, TX2, . . . , TXm) or in the receiving branches (RX1, RX2, . . . , RXm) so that the amplitude and phase variations derived in step c) are minimized.

8 Claims, 1 Drawing Sheet

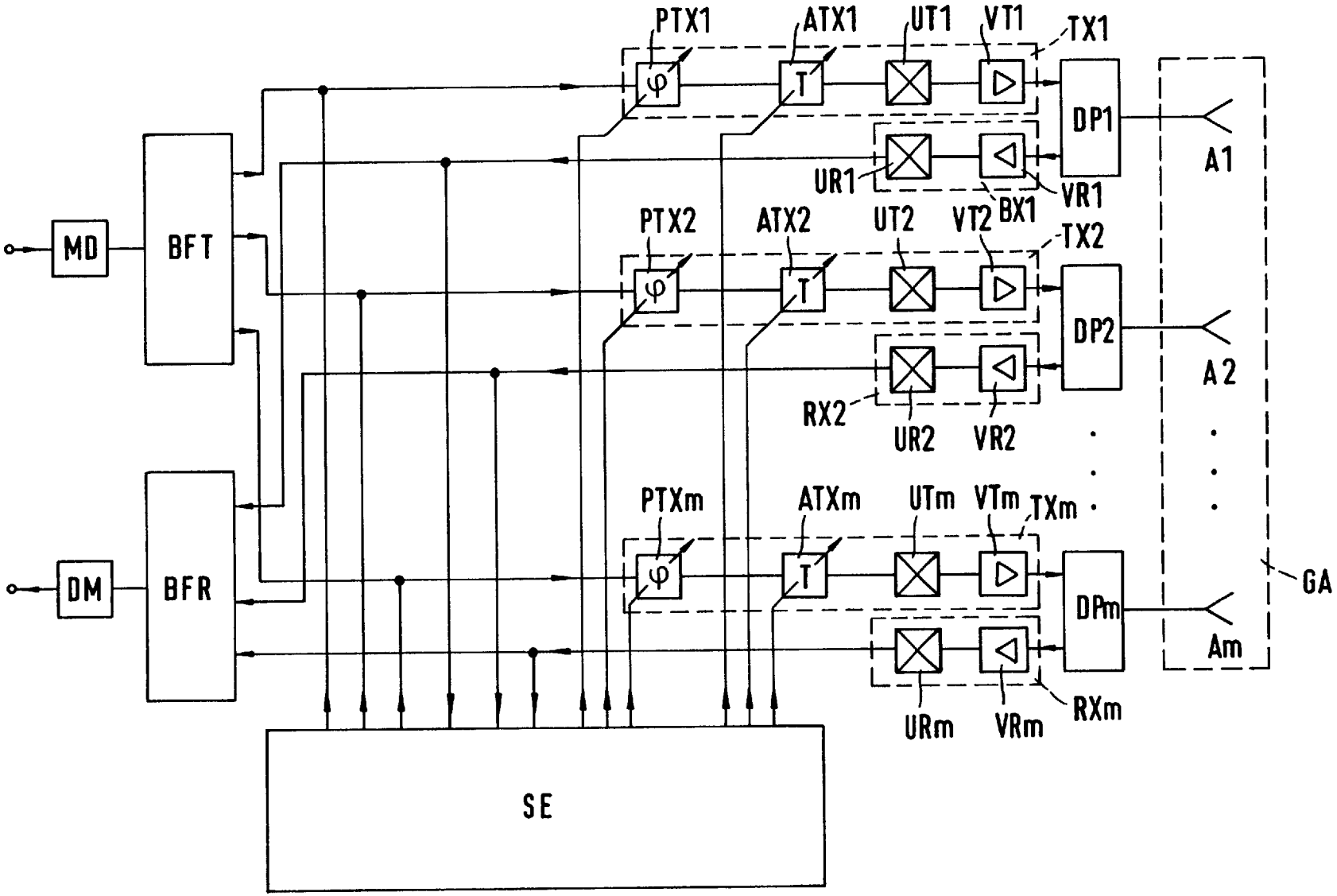
GA
A1
A2
Am
DP1
DP2
DPm
TX1
VR1
TX2
TXm
RXm
VT1
BX1
VT2
VR2
VTm
VRm
UT1
UT2
UR2
UTm
URm
UR1
RX2
ATX1
ATX2
ATXm
PTX1
PTX2
PTXm
SE
BFT
BFR
MD
DM

METHOD OF CALIBRATING A GROUP ANTENNA

BACKGROUND OF THE INVENTION

1. Field of the Invention

The present invention relates to a method of calibrating the transmitting and receiving branches of a group antenna.

2. Prior Art

Group antennas are described in International Application WO 95/31403. In these known group antennas a predetermined transmission signal is fed to the individual antenna elements in each transmitting branch for calibration of the transmitting branches and the superimposed signal on it is decoupled at the end of each transmitting branch. The signal decoupled at the end of each signal branch is compared with the predetermined transmission signal fed into it. A deviation found from the comparison of the signals is compensated by an amplitude and phase adjustment in the appropriate transmission branch.

A calibration of the receiving branch occurs by feeding a predetermined reception signal into the individual receiving branches and again decoupling the superimposed signal on it at the end of receiving branches. An adjustment of the amplitude and phase in the concerned receiving branch is performed depending on the shift between the signal that is fed in and decoupled signal in each receiving branch. This prior art calibration method does not balance or compensate for errors caused by the antenna elements, since the transmission behavior of the antenna elements are not considered in this method.

SUMMARY OF THE INVENTION

It is an object of the present invention to provide a calibration method of a group antenna of the above-described kind, with which the transmitting and receiving branches of the group antenna can be calibrated including the antenna elements belonging to them in as simple a manner as possible.

According to the invention the method comprises the steps of:

a) sending a respective calibrating signal over a plurality of corresponding transmitting branches one after the other;

b) detecting superimposed signal components coupled into respective individual antenna elements of the group antenna for each calibrating signal sent over the corresponding transmitting branches in the receiving branches belonging to the respective individual antenna elements;

c) deriving amplitude and phase variations of a transmission function of each of the transmitting branches or receiving branches relative to a transmission function of a reference transmitting or receiving branch from received signals including the superimposed signal components detected in the corresponding receiving branches for all calibrating signals; and d) adjusting amplitude adjusting elements and phase adjusting elements in the respective individual transmitting branches or in the receiving branches so that the amplitude and phase variations derived in step c) are minimized.

Electronic controllable duplex group antennas are used in radar and communication systems, when the antenna propagation diagram required in transmission and reception applications must have a flexible shape with a high spatial selectivity. In practice an exact form for the antenna propagation diagram is only possible with group antennas, when the variations of the transmission properties of the individual receiving and transmitting branches necessarily present are exactly known and compensated. A calibration of the group antenna in which the transmission properties of the receiving and transmitting branches are adjusted in regard to amplitude and phase is thus required from time to time. With the method according to the invention the calibration may be performed with comparatively little effort considering the transmission properties of the individual antenna elements.

Advantageous further embodiments of the invention are claimed and described in the dependent claims appended hereinbelow.

A quotient is formed from the transmission function determined for the other transmitting or receiving branches and the transmission function of the reference transmitting or receiving branch. This quotient is used as an adjustment parameter for the adjusting of the amplitude and phase elements in the transmitting and receiving branches.

Advantageously a transmitting or receiving branch is selected as the reference transmitting or receiving branch whose transmission function is approximately one.

In order to compensate for measurement errors it is advantageous to derive an average adjustment parameter for each transmitting or receiving branch by forming the respective transmission function quotients with respect to several reference transmitting or receiving branches and to find the average quotient.

In a group antenna whose antenna elements are arranged linearly with equal spacing, the transmitting or receiving branches preferably are adjusted to equal amplitude and phase values, beginning in the center of the linear group antenna and continuing toward the antenna elements on the outside.

Errors in adjusting the amplitude and phase elements can be corrected by performing several redundant measurements of the transmission functions for determination of the adjusting parameters and performing an averaging of the measurements.

BRIEF DESCRIPTION OF THE DRAWING

The objects, features and advantages of the invention will now be explained in more detail with the aid of the following description of the preferred embodiments, with reference to the accompanying drawing in which the sole FIGURE is a schematic circuit diagram of a device for performing the method of calibrating the group antenna according to the invention.

DESCRIPTION OF THE PREFERRED EMBODIMENTS

The time duplex radio system shown in the sole FIGURE has a group antenna with m antenna elements. The antenna elements A1, A2, . . . , Am are illustrated in the sole FIGURE. The term "time duplexability" means that the group antenna can alternately can transmit and receive in one frequency band and uses the same antenna elements for both transmission and electricity. Thus each antenna element A1, A2, . . . , Am is connected to a duplexer DP1, DP2, . . . , DPm. The duplexers DP1, DP2, . . . , DPm in a known manner connect the respective transmitting branch TX1, TX2, . . . , TXm to the corresponding antenna elements A1, A2, . . . , Am in transmission and in reception the respective receiving branches RX1, RX2, . . . , RXm to the corresponding antenna elements A1, A2, . . . , Am. The individual transmitting branches TX1, TX2, . . . , TXm and the receiving branches RX1, RX2, . . . , RXm have at least one amplifier VT1, VT2, . . . , VTm and VR1, VR2, . . . , VRm and at least one converter UT1, UT2, . . . , UTm and UR1, UR2, . . . , URm, which convert a base band signal or an intermediate frequency signal into a high frequency signal or a high frequency signal into a base band signal or an intermediate frequency signal. According to the circumstances the transmitting and receiving branches also contain a digital-to-analog or analog-to-digital converter, when the duplex radio system operates in a digital manner.

In the embodiment shown in the drawing the transmitting branches should be calibrated, so that they should also be equipped with an amplitude adjusting element ATX1, ATX2, . . . , ATXm and with a phase adjusting element PTX1, PTX2, . . . , PTXm. For the reverse case, i.e. in an alternative embodiment, the receiving branches to be calibrated must be equipped with amplitude and phase adjusting elements.

The output terminals of the receiving elements RX1, RX2, . . . , RXm are connected to a radiating network BFR, to whose output a demodulator DM is connected. For the transmission direction a radiating network BFT is provided, which divides the output signal of a modulator MD between the individual transmitting branches TX1, TX2, . . . , TXm with suitable weighting factors.

Finally a control device SE is provided, from which calibrating signals can be input to the individual transmitting branches TX1, TX2, . . . , TXm and received signals can be decoupled from the individual receiving branches RX1, RX2, . . . , RXm. Furthermore the control device SE is responsible for control of the amplitude adjusting elements ATX1, ATX2, . . . , ATXm and the phase adjusting element PTX1, PTX2, . . . , PTXm. The calibration method performed by the control device SE is now described in more detail.

It is based on the pre-condition that the receiving branches RX1, RX2, . . . , RXm are already calibrated and now the transmitting branches TX1, TX2, . . . , TXm should now be calibrated. The calibration method according to the invention can also be performed under the presumption that the transmitting branches TX1, TX2, . . . , TXm are already calibrated and the receiving branches RX1, RX2, . . . , RXm then should be calibrated.

For the calibrating method a calibrating signal is sent out from one of the transmitting branches TX1, TX2, . . . , TXm that should be designated as a reference transmission branch. The transmitted signal radiated by the antenna element associated with the reference transmission channel is superimposed to a certain extent on the neighboring antenna elements. A more or less larger portion of the radiated energy in this antenna element is superimposed according to the spacing of the antenna elements relative to the reference transmission branch. The control device SE measures the superimposed signal components from the reference transmitting branch in each individual receiving branch RX1, RX2, . . . , RXm. Each of the m transmitting branches TX1, TX2, . . . , TXm are operated one after the other as the reference transmitting branch and the respective superimposed signal components in the remaining receiving branches RX1, RX2, . . . , RXm are detected by the control device SE. The signals received in this way by the control device SE may be represented in the form of a matrix D according to equations (1) and (2) below.

$$\begin{pmatrix} x_1 \\ x_2 \\ x_3 \\ \vdots \\ x_m \end{pmatrix} = diag(r) \cdot \underbrace{\overbrace{\begin{pmatrix} g_{11} & g_{12} & g_{13} & \cdots & g_{1m} \\ g_{21} & g_{22} & g_{23} & \cdots & g_{2m} \\ g_{31} & g_{32} & g_{33} & \cdots & g_{3m} \\ \vdots & \vdots & \vdots & \ddots & \vdots \\ g_{m1} & g_{m2} & g_{m3} & \cdots & g_{mm} \end{pmatrix}}^{G}}_{D} \cdot diag(s) \cdot \begin{pmatrix} k_1 \\ k_2 \\ k_3 \\ \vdots \\ k_m \end{pmatrix} \tag{1}$$

with $$diag(r) = \begin{pmatrix} r_1 & 0 & 0 & \dots & 0 \\ 0 & r_2 & 0 & \ddots & 0 \\ 0 & \ddots & r_3 & \ddots & \vdots \\ \vdots & \ddots & \ddots & \ddots & 0 \\ 0 & \dots & 0 & 0 & r_m \end{pmatrix} \text{ und } diag(s) = \begin{pmatrix} s_1 & 0 & 0 & \dots & 0 \\ 0 & s_2 & 0 & \ddots & 0 \\ 0 & \ddots & s_3 & \ddots & \vdots \\ \vdots & \ddots & \ddots & \ddots & 0 \\ 0 & \dots & 0 & 0 & s_m \end{pmatrix} \tag{2}$$

In equation (1) the matrix G gives the coupling between the individual antenna elements A1, A2, . . . , Am. This matrix $G=[g_{ik}]$ (i,k=1, 2, . . . , m) is unknown. Because of the pre-conditions set forth regarding the duplexability of the antenna elements A1, A2, . . . , Am the structure of the matrix G is known. The diagonal matrices diag (r) and diag (s) given in equation (2) contain the complex valued transmission function of the transmitting branches (s) and receiving branches (r). The frequency dependence of the transmission function is not considered here, because the method here is based on use of a calibrating signal that is small banded or monochromatic (single frequency). If it is necessary to calibrate in a wide frequency band, several small band measurements in displaced frequency bands are performed.

In equation (1) x stands for the receiving signal vector and k, the calibrating signal vector. The equation (1) makes it clear that the elements of the matrix D can be measured column-wise by means of the receiving signal vector x. Also all elements in the calibrated signal vector k are set to 0 until at one element. This one element describes the calibrated signal, which is transmitted by means of one of the antenna elements A1, A2, . . . , Am and which is received by the remaining elements on account of the superposition.

Since, as mentioned above, it is assumed that the receiving branches RX1, RX2, . . . , RXm of the group antenna are already calibrated, the matrix diag (r) may be described as a unitary matrix, which can scaled with a complex factor. However since the calibration only involves the ratio between individual elements of the group antenna, this factor can be set equal to 1. In the above-described column-wise measurement of the matrix D it is not possible to measure the diagonal elements of D, because the antenna elements can simultaneously transmit and receive in time duplex operation. Thus the diagonal elements of the matrix D are set to 0 in the following. According to the above-mentioned boundary conditions the matrix D may also be described as follows in equation (3):

$$D = \begin{pmatrix} 0 & g_{12}s_2 & \cdots & g_{1(m-1)}s_{m-1} & g_{1m}s_m \\ g_{21}s_1 & 0 & \ddots & \vdots & g_{2m}s_m \\ g_{31}s_1 & g_{32}s_2 & \ddots & g_{3(m-1)}s_{m-1} & \vdots \\ \vdots & \vdots & \ddots & 0 & g_{(m-1)m}s_m \\ g_{m1}s_1 & g_{m2}s_2 & \cdots & g_{m(m-1)}s_{m-1} & 0 \end{pmatrix} \tag{3}$$

As already noted the coupling matrix G is generally unknown. However since the equal antenna elements of the group antenna alternately send and receive, the coupling elements between the elements A1, A2, . . . , Am are reciprocal. That means that the coupling, and thus the transmission function, e.g. between the elements 2 and 3, is the same as that between the elements 3 and 2. The matrix G is also symmetric to its principal diagonal. This may seem obvious, but it is only valid because the same antenna elements A1, A2, . . . , Am are used for transmitting and receiving at a common frequency.

For a group antenna with six antenna elements (m=6) the following matrix D results.

$$D=\begin{pmatrix} 0 & g_{12}s_2 & g_{13}s_3 & g_{14}s_4 & g_{15}s_5 & g_{16}s_6 \\ g_{12}s_1 & 0 & g_{23}s_3 & g_{24}s_4 & g_{25}s_5 & g_{26}s_6 \\ g_{13}s_1 & g_{23}s_2 & 0 & g_{34}s_4 & g_{35}s_5 & g_{36}s_6 \\ g_{14}s_1 & g_{24}s_2 & g_{34}s_3 & 0 & g_{45}s_5 & g_{46}s_6 \\ g_{15}s_1 & g_{25}s_2 & g_{35}s_3 & g_{45}s_4 & 0 & g_{56}s_6 \\ g_{16}s_1 & g_{26}s_2 & g_{36}s_3 & g_{46}s_4 & g_{56}s_5 & 0 \end{pmatrix} \tag{4}$$

The aim of the calibration is to balance the transmission functions $s_1$ to $s_m$ with respect to each other, so that the matrix diag (s) corresponds to one of the unitary matrices scaled with a complex factor. The value of this complex scaling factor is irrelevant for the calibration. The goal of the calibration thus is:

$$s_1=s_2=\ldots=s_m \tag{5}$$

The control device SE produces this equality of the transmission functions of the transmitting branches by adjusting the amplitude adjusting elements ATX1, ATX2, . . . , ATXm and the phase adjusting elements PTX1, PTX2, . . . , PTXm. For illustration in the FIGURE the amplitude adjusting elements ATX1, ATX2, . . . , ATXm and the phase adjusting elements PTX1, PTX2, . . . , PTXm are shown as concrete structural elements. The adjusting of the amplitudes and phases is however appropriately performed by suitable complex weighting of the transmission signals for the individual transmitting branches TX1, TX2, . . . , TXm.

The aim of the calibration is to determined adjusting parameters by which the amplitude adjusting elements ATX1, ATX2, . . . , ATXm and the phase adjusting elements PTX1, PTX2, . . . , PTXm must be adjusted so that the transmission functions of all transmission channels are all equal according to equation (5). For this purpose so-called normalized representative vectors $w_i$ of the transmission functions $s_1$ to $s_m$ are determined by the control device SE, since the ith column vector of the matrix D is divided element-wise by the ith row vector of the matrix D. The ith place in the representative vector $w_i$ is put equal to 1, because division by zero is not defined. In equation (6) an example $w_2$ of the representative vectors $w_1$ to $w_2$ formed from the second row and the second column of the matrix D is shown.

$$w_2=\left(\frac{g_{12}s_2}{g_{12}s_1}\quad 1\quad \frac{g_{23}s_2}{g_{23}s_3}\quad \frac{g_{24}s_2}{g_{24}s_4}\quad \frac{g_{25}s_2}{g_{25}s_5}\quad \frac{g_{26}s_2}{g_{26}s_6}\right)^T \tag{6}$$

$$\Leftrightarrow w_2=\left(\frac{s_2}{s_1}\quad 1\quad \frac{s_2}{s_3}\quad \frac{s_2}{s_4}\quad \frac{s_2}{s_5}\quad \frac{s_2}{s_6}\right)^T$$

Thus m different representative vectors $w_1$ to $w_m$ can be determined. These are linearly dependent, i.e. they differ only by respective other scaling and each individual element of this representative vector contains sufficient information for this calibration. Since in practice the matrix D can not be measured in an error-free manner, the representative vectors cannot be linearly independent. In this case the effects of measurement errors can be reduced by averaging these representative vectors. The representative vectors $w_1$ to $w_6$ should be averaged according to the theory of measurement as follows:

$$w_1=\left(1\quad \frac{s_1}{s_2}\quad \frac{s_1}{s_3}\quad \frac{s_1}{s_4}\quad \frac{s_1}{s_5}\quad \frac{s_1}{s_6}\right)^T$$

$$w_2=\left(\frac{s_2}{s_1}\quad 1\quad \frac{s_2}{s_3}\quad \frac{s_2}{s_4}\quad \frac{s_2}{s_5}\quad \frac{s_2}{s_6}\right)^T$$

$$\vdots$$

$$w_6=\left(\frac{s_6}{s_1}\quad \frac{s_6}{s_2}\quad \frac{s_6}{s_3}\quad \frac{s_6}{s_4}\quad \frac{s_6}{s_5}\quad 1\right)^T$$

Since the vectors are linearly dependent, the following steps can be performed to obtain an average. Each vector is normalized to its first element. Thus the first element of each vector becomes 1. Then the normalized vector can be averaged. The average can be performed element-wise as an arithmetic average. The kth element of the averaged vector results from the summation of the respective kth elements of all normalized vector and subsequently divided by the number of vectors (in this example 6).

Median formation is another method of averaging. This method has the advantage that individual elements deviating greatly from the median have little influence on the average result. Since the vector elements are generally complex numbers, the median formation should occur according to the magnitude and argument. The kth element of the averaged vector has the magnitude that results from the median of the amounts of the respective kth elements of the normalized vectors. The argument of the averaged vector is determined as the median of the arguments of the kth elements of the normalized vectors.

After the control device SE determines a representative vector, the transfer functions of the individual transmitting branches are adjusted one after the other so that they correspond to the complex values of the representative vector. Thus e.g. the representative vector $w_2$ from equation (6) is used for the calibration. Then the following adjustment is performed for the first transmitting branch TX1. The complex value element in the representative vector $w_2$ for the first transmitting branch TX1 is given again in equation (7).

$$W_{2,1}=\{s_2/s_1\}=|(s_2/s_1)\cdot\exp[j\phi_{12}] \tag{7},$$

wherein $\phi_{12}$ is the phase of $s_2/s_1$.

The amplitude adjusting element ATX1 of the first transmitting branch must thus be adjusted about the amount $s_2/s_1$ and the phase adjusting element PTX1 must be adjusted about the angle $\phi_{12}$. Thus the first transmitting branch now has the same transmission function as the second transmitting branch. By suitable adjustments the transmission functions for the remaining transmitting branches are similarly adjusted to the transmission function $s_2$ of the second transmitting branch. The required adjusting values are taken from the appropriate elements of the representative vector $w_2$. The amplitude adjusting element ATX2 and the phase adjusting element PTX2 of the second branch remain unchanged, since the remaining branches are balanced immediately in this adjustment. Thus finally all transmitting branches of the group antenna have the same transmission function with the complex value $s_2$.

That the adjusted transmission factor $s_i$ for all transmitting branches should have a magnitude of approximately one after the calibration should be considered in the selection of the representative vector $w_i$. Because of that it should be guaranteed that the antennae operate in their original dynamic region after calibration and the amplitude adjusting elements are not overdriven. In the event that none of the representative vectors fulfill this criterion, all amplitude adjusting elements ATX1, ATX2, . . . , ATXm are simultaneously scaled so that the magnitude of the resulting transmission function is as close as possible to one. The success of the calibration can be tested in intervening time and at the end by new measurement of the calibration matrix D.

In the foregoing description it has been assumed that the matrix D given in equation (4) is measured completely. In practice however this is not appropriate. The amounts of the coupling parameters $g_{ik}$ decrease very rapidly with increasing spacing between the antenna elements A1, A2, . . . , Am. As already mentioned, the matrix D contains much redundancy and thus it is possible to perform a calibration with a matrix D only partially determined. If only a few elements of the matrix D have been determined, it must be determined whether or not a balancing is possible according to equation (5) with the help of these entries. At least m−1 entries that are not redundant must be determined.

Subsequently the special case of a linear group antenna with equally spaced antenna elements A1, A2, . . . , Am is considered. In this type of linear group antenna the coupling parameters on the side diagonals of the matrix G have equal magnitudes. With linear group antennas it is possible, e.g., to use only the coupling parameter of each antenna element with its nearest neighboring element. Only the first side diagonal pair from the matrix D that is symmetric to the main diagonal needs to be determined. The equation (8) shows this for example for the case m=6.

$$D=\begin{pmatrix} 0 & g_{12}s_2 & 0 & 0 & 0 & 0 \\ g_{12}s_1 & 0 & g_{23}s_3 & 0 & 0 & 0 \\ 0 & g_{23}s_2 & 0 & g_{34}s_4 & 0 & 0 \\ 0 & 0 & g_{34}s_3 & 0 & g_{45}s_5 & 0 \\ 0 & 0 & 0 & g_{45}s_4 & 0 & g_{56}s_6 \\ 0 & 0 & 0 & 0 & g_{56}s_5 & 0 \end{pmatrix} \tag{8}$$

In this case the amplitude and the phase adjusting elements are adjusted starting with the average transmitting branch so that the elements with equal coupling parameters $g_{ik}=g_{ki}$ in the matrix D take equal complex values after the product formation with the transmission functions $s_i$ and $s_k$. In the example from equation (8) thus the amplitude and phase adjusting elements are balanced so that the entries $g_{34}s_3$ and $g_{34}s_4$ in the matrix D are equal. The transmitting branches 3 and 4 are thus adjusted with respect to each other and their amplitude and phase adjusting elements are changed in the course of the calibration, only still equally. This means that the amplitude and phase adjusting elements of both branches are coupled with each other. A change of the amplitude and phase adjusting elements in one of both branches causes a change in the amplitude and phase adjusting elements in the other branch. The success of the adjusting can be checked by a new measurement of the appropriate elements of the calibrating matrix D.

In the subsequent step of the calibration the amplitude and phase adjusting elements of the transmitting branches 2 and 5 in the above-described example are adjusted with the already calibrated adjusting elements of the transmitting branches 3 and 4. The goal is thus to subsequently adjust the elements $g_{12}s_1$ and $g_{12}s_2$ as well as the elements $g_{45}s_4$ and $g_{45}s_5$ of the matrix D respectively pairwise. Thus the amplitude and phase adjusting elements of the transmitting branches 2 to 5 are adjusted with respect to each other and their amplitude and phase adjusting elements are changed in the course of the further calibration only proportionally. The described process is continued until at the outermost transmitting branch.

A linear group antenna with equally spaced antenna elements A1, A2, . . . , Am has additionally structural symmetry properties in relation to its average point, which is established by the half way point at the connecting node between the outermost antenna elements. In practice, the obtainable structural symmetry depends on the particular embodiment of the group antenna. If the group antenna, e.g., is made as a printed circuit on a substrate in strip line technology, then a very good structural symmetry is obtainable. If the structure can be assumed to be symmetric, then the matrix G has the property that it is symmetric in regard to a rotation by 180°. This means that the matrix D is transformed into itself, after a rotation of 180°. The ith column of the matrix finds itself in the (m−i+1)th column. Each column and/or row appears four times in the matrix G because of the reciprocity together with the column/row equivalence. The measurement of the matrix D however still contains much redundancy, which can be used for error correction. Thus the following equation (9) results for the calibration matrix D from equation (8) after taking account of built-in symmetry.

$$D=\begin{pmatrix} 0 & g_{12}s_2 & 0 & 0 & 0 & 0 \\ g_{12}s_1 & 0 & g_{23}s_3 & 0 & 0 & 0 \\ 0 & g_{23}s_2 & 0 & g_{34}s_4 & 0 & 0 \\ 0 & 0 & g_{34}s_3 & 0 & g_{23}s_5 & 0 \\ 0 & 0 & 0 & g_{23}s_4 & 0 & g_{12}s_6 \\ 0 & 0 & 0 & 0 & g_{12}s_5 & 0 \end{pmatrix} \tag{9}$$

The calibration can be performed for the case of no structural symmetry as before. After the calibration the redundancy, which is contained in the calibration matrix because of the structural symmetry, allows an additional check of the calibration that has been performed. The matrix D must be point symmetric at its average point after calibration. The elements in the matrix D, which should be identical after calibration, occur also in quadruples instead of in pairs in the case of no structural symmetry.

Since the elements in the matrix D are determined by measurement technology, the nominal equal entries in practice are not exactly equal. An average over four measurement steps thus provides a certain protection against possible measurement errors.

The disclosure in German Patent Application 199 43 952.4 of Sep. 14, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method of calibrating a group antenna, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

1. A method of calibrating a group antenna, said group antenna comprising antenna elements (A1, A2, . . . , Am), transmitting branches (TX1, TX2, . . . , TXm), receiving branches (RX1, RX2, . . . , RXm), means (BFT) for connecting said transmitting branches to said antenna elements for transmission, means (BFR) for connecting said receiving branches to said antenna elements for reception, said transmitting branches (TX1, TX2, . . . , TXm) including amplitude adjusting elements (ATX1, ATX2, . . . , ATXm) and phase adjusting elements (PTX1, PTX2, . . . , PTXm) so that amplitude and phase in said transmitting branches are adjustable, said method comprising the steps of:

a) inputting a calibrating signal into one of the transmitting branches (TX1, TX2, . . . , TXm) acting as a reference branch so that said calibrating signal is radiated by an associated one of said antenna elements connected to said reference branch and thus superimposed on others of said antenna elements not connected to said reference branch;

b) measuring superimposed signal components from the reference branch in said receiving branches (RX1, RX2, . . . , RXm);

c) selecting each of said transmitting branches as said reference branch one after the other and repeating said inputting and said measuring of steps a) and b) for each of said transmitting branches;

d) deriving relative amplitude and phase variations of transmission functions ($s_1$, $s_2$, . . . , $s_m$) for said transmitting branches (TX1, TX2, . . . , TXm) with respect to a transmission function for a representative transmission branch, said relative amplitude and said phase variations being derived from received signals including said superimposed signal components detected in said receiving branches (RX1, RX2, . . . , RXm) for all of said calibrating signals; and e) adjusting said amplitude adjusting elements (ATX1, ATX2, . . . , ATXm) and said phase adjusting elements (PTX1, PTX2, . . . , PTXm) in said transmitting branches (TX1, TX2, . . . , TXm) so that said amplitude and phase variations derived in step d) are minimized.

2. The method as defined in claim 1, wherein said transmission function of said representative transmitting branch has a magnitude of approximately one.

3. A method of calibrating a group antenna, said group antenna comprising antenna elements (A1, A2, . . . , Am), transmitting branches (TX1 , TX2, . . . , TXm), receiving branches (RX1, RX2, . . . , RXm), means (BFT) for connecting said transmitting branches to said antenna elements for transmission, means (BFR) for connecting said receiving branches to said antenna elements for reception, said transmitting branches (TX1, TX2, . . . , TXm) including amplitude adjusting elements (ATX1, ATX2, . . . , ATXm) and phase adjusting elements (PTX1, PTX2, . . . , PTXm) so that amplitude and phase in said transmitting branches are adjustable, said method comprising the steps of:

a) inputting a calibrating signal into one of the transmitting branches (TX1, TX2, . . . , TXm) acting as a reference branch so that said calibrating signal is radiated by an associated one of said antenna elements connected to said reference branch and thus superimposed on others of said antenna elements not connected to said reference branch;

b) measuring superimposed signal components from the reference branch in said receiving branches (RX1, RX2, . . . , RXm);

c) selecting each of said transmitting branches as said reference branch one after the other and repeating said inputting and said measuring of steps a) and b) for each of said transmitting branches;

d) deriving relative amplitude and phase variations of transmission functions ($s_1$, $s_2$, . . . , $s_m$) for said transmitting branches (TX1, TX2, . . . , TXm) with respect to a transmission function for a representative transmission branch, said relative amplitude and said phase variations being derived from received signals including said superimposed signal components detected in said receiving branches (RX1, RX2, . . . , RXm) for all of said calibrating signals;

e) forming respective quotients from said transmission functions for said transmitting branches and said transmission function for said representative transmission branch; and f) adjusting said amplitude adjusting elements (ATX1, ATX2, . . . , ATXm) and said phase adjusting elements (PTX1, PTX2, . . . , PTXm) in said transmitting branches (TX1, TX2, . . . , TXm) according to said respective quotients so that said amplitude and phase variations derived in step d) are minimized.

4. The method as defined in claim 3, wherein said transmission function of said representative transmitting branch has a magnitude of approximately one.

5. The method as defined in claim 3, further comprising deriving an averaged adjusting parameter for adjustment of said amplitude adjusting elements (ATX1, ATX2, . . . , ATXm) and phase adjusting elements (PTX1, PTX2, . . . , PTXm) for each of said transmitting branches (TX1, TX2, . . . , TXm), wherein a number of said respective quotients are formed for a number of different reference transmitting branches and said averaged adjusting parameter is equal to an average of said number of said respective quotients.

6. The method as defined in claim 3, wherein the group antenna includes a linear arrangement of said antenna elements (A1, A2, . . . , Am) equally spaced from each other and the transmitting branches (TX1, TX2, . . . , TXm) beginning in a central part of the group antenna and continuing toward an outside thereof are balanced to equal amplitude and phase values.

7. The method as defined in claim 3, wherein balancing errors occurring during adjustment of said amplitude adjusting elements (ATX1, ATX2, . . . , ATXm) and phase adjusting elements (PTX1, PTX2, . . . , PTXm) are corrected by performing several redundant determinations of the transmission functions for determination of the adjustment variables or parameters and averaging the redundant determinations of the transmission functions.

8. A method of calibrating a group antenna, said group antenna comprising antenna elements (A1, A2, . . . , Am), transmitting branches (TX1, TX2, . . . , TXm), receiving branches (RX1, RX2, . . . , RXm), means (BFT) for connecting said transmitting branches to said antenna elements for transmission, means (BFR) for connecting said receiving branches to said antenna elements for reception, said receiving branches (RX1, RX2, . . . , RXm) including amplitude adjusting elements and phase adjusting elements so that amplitude and phase in said receiving branches are adjustable, said method comprising the steps of:

a) inputting a calibrating signal into one of the transmitting branches (TX1 , TX2, . . . , TXm) acting as a reference branch so that said calibrating signal is radiated by an associated one of said antenna elements connected to said reference branch and thus superimposed on others of said antenna elements not connected to said reference branch;

b) measuring superimposed signal components from the reference branch in said receiving branches (RX1, RX2, . . . , RXm);

c) selecting each of said transmitting branches as said reference branch one after the other and repeating said inputting and said measuring of steps a) and b) for each of said transmitting branches;

d) deriving relative amplitude and phase variations of reception functions for said receiving branches with respect to a reception function for a representative reception branch, said relative amplitude and said phase variations being derived from transmitted signals including said superimposed signal components detected in said receiving branches (RX1, RX2, . . . , RXm) for all of said calibrating signals; and e) adjusting said amplitude adjusting elements and said phase adjusting elements in said receiving branches so that said amplitude and phase variations derived in step d) are minimized.

* * * * *